US008905057B2

(12) United States Patent
Sass

(10) Patent No.: US 8,905,057 B2
(45) Date of Patent: Dec. 9, 2014

(54) WATER DAMAGE PREVENTION SHUNT PAN AND INDICATOR FOR APPLIANCES

(76) Inventor: Leland W. Sass, Apache Junction, AZ (US)

( * ) Notice: Subject to any disclaimer, the term of this patent is extended or adjusted under 35 U.S.C. 154(b) by 178 days.

(21) Appl. No.: 13/278,631

(22) Filed: Oct. 21, 2011

(65) Prior Publication Data

US 2013/0098470 A1 Apr. 25, 2013

(51) Int. Cl.
*B65D 1/14* (2006.01)
*A47L 15/42* (2006.01)

(52) U.S. Cl.
CPC ..... *A47L 15/4212* (2013.01)
USPC ..... 137/15.11; 137/312; 137/551; 137/552

(58) Field of Classification Search
USPC ..... 137/15.01, 15.11, 312, 551, 552; 220/571; 222/108; 4/251.1
See application file for complete search history.

(56) References Cited

U.S. PATENT DOCUMENTS

| | | | | |
|---|---|---|---|---|
| 3,304,950 | A * | 2/1967 | Hubert | 137/312 |
| 4,903,723 | A * | 2/1990 | Sublett | 137/312 |
| 6,938,792 | B2 * | 9/2005 | Gerger | 220/571 |
| 7,757,705 | B2 * | 7/2010 | Carter | 220/571 |

* cited by examiner

*Primary Examiner* — Kevin Lee
(74) *Attorney, Agent, or Firm* — The Hill Law Firm, PLC; Scott A. Hill

(57) ABSTRACT

A shunt pan is used to prevent excessive water damage from occurring if water leaking from a kitchen appliance is not discovered in a timely manner. The shunt pan directs the flow of collecting water into a walkway of a kitchen, where it is visible, rather than allowing the water to soak into surrounding kitchen walls and cabinets. A shunt pan is characterized by a rectangular floor bordered on three sides by walls, but not bordered by a physical obstruction on the fourth side, which is open. Preferably, the open side includes an indicator material, such as confetti or glitter in a water-soluble binder, that can be carried by flowing water into the walkway. If the water that carried the indicator material evaporates, the indicator material will remain in the walkway to clearly show the presence of a water leak.

17 Claims, 4 Drawing Sheets

WATER DAMAGE PREVENTION SHUNT PAN AND INDICATOR FOR APPLIANCES

BACKGROUND OF THE INVENTION

Several kitchen appliances are prone to leak water for various reasons, especially dishwashers, ice makers and under-the-sink water filtration systems. Often, there is no obvious indication that a water leak exists until after expensive water damage has occurred. For example, a slow water leak under a dishwasher is extremely unlikely to be discovered because a dishwasher is rarely moved after it is installed. Before there are any obvious signs that a water leak exists, there is often mold damage, swelling and blistering of cabinets, extensive water absorption by nearby plasterboard, and damage to flooring. A common drip pan could delay some of this water damage, but the indication of the presence of a water leak is still not communicated until there are obvious visual or olfactory indications of water damage.

Some other home appliances that are prone to leak water include hot water heaters and washing machines. There are special overflow pans designed to catch drips and leaks from such appliances, and these pans often include a drain hose used to divert leaking water to a drain or outside. The problem with using an overflow pan under a dishwasher or refrigerator, besides being rather unsightly, is the extreme difficulty of positioning an overflow pan under the appliance either because the appliance is too heavy or because there is not adequate clearance. There is a need for a way to prevent excessive water damage from occurring under kitchen appliances that cannot accommodate an overflow pan.

SUMMARY OF THE INVENTION

The present invention is a rectangular shunt pan characterized by three walled sides and an open side. The walled sides prevent water from puddling against walls and cabinets, and the open side directs the flow of water into a walkway of a kitchen such that leaking water is visible to someone walking through the kitchen. For a very slow water leak, small amounts of water will simply evaporate off the floor of the shunt pan rather than be absorbed by walls and cabinets. In a preferred embodiment of the invention, an indicator material is applied to the floor of the shunt pan, preferably along the open side, such that the indicator material will be carried by leaking water into the walkway of a kitchen. The advantage of the preferred embodiment is that the indicator material will remain on a walkway, where it is clearly visible, even if the water that delivered the indicator material evaporates. Some examples of indicator materials include marking chalk, confetti, glitter, or an expanding sponge material. An alternative embodiment is characterized by indicator material that is a non-toxic vapor producing chemical reaction that emits a visible gas or offensive smell.

Figure 1:
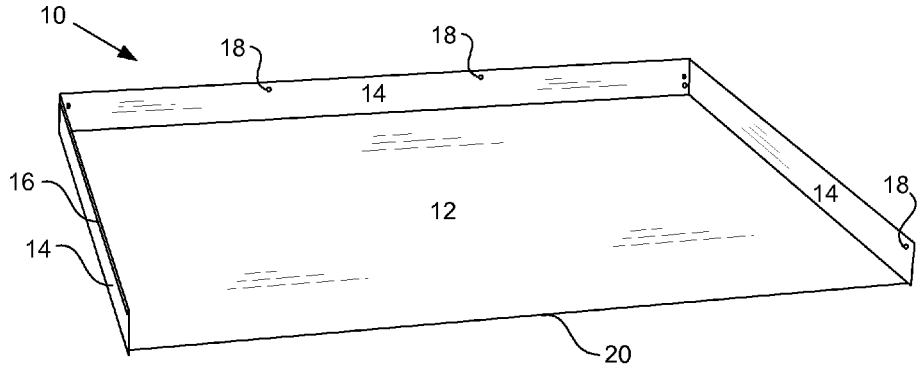
FIG. 1 is front perspective view of a shunt pan of the present invention.
Figure 2:
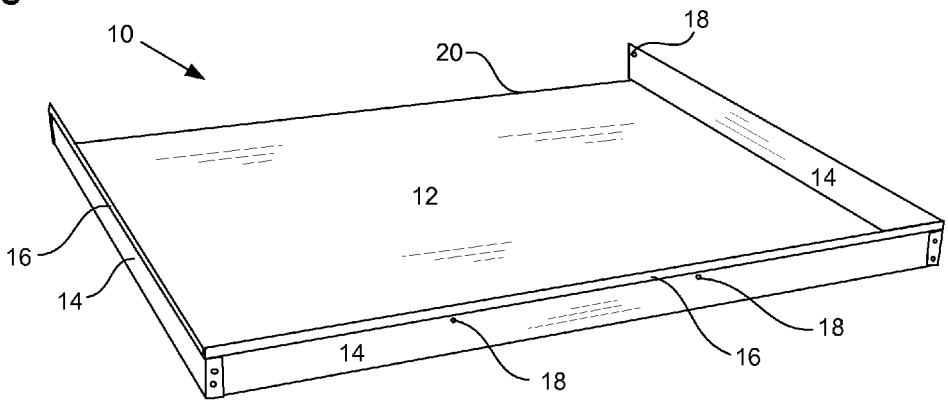
FIG. 2 is a rear perspective view of the shunt pan of FIG. 1.
Figure 3:
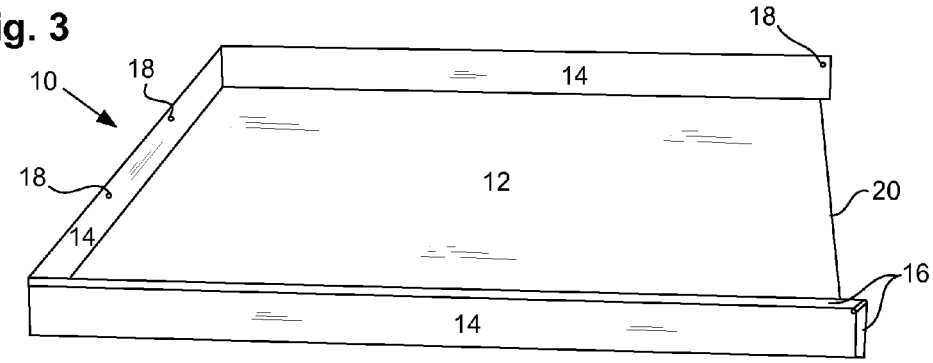
FIG. 3 is a side perspective view of the shunt pan of FIG. 1.
Figure 4:
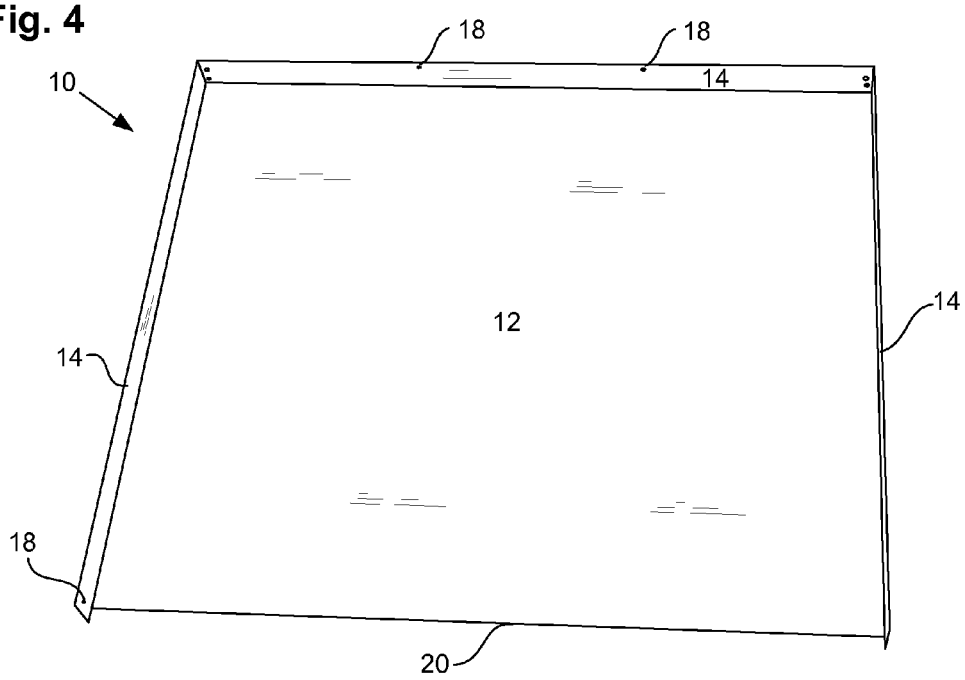
FIG. 4 is a top perspective view of the shunt pan of FIG. 1.

The following is the list of numerical callouts used in FIGS. 1-8*a*:

10 shunt pan
12 floor
14 walled sides
16 safety edge
18 fastener holes
20 open side
22 diversion ridge
24 diversion edge
26 shunt passageway
30 indicator material
32 water-soluble binder
40 expanding sponge material
42 magnetic strip
44 printed warning

DETAILED DESCRIPTION OF THE INVENTION

Figure 7:
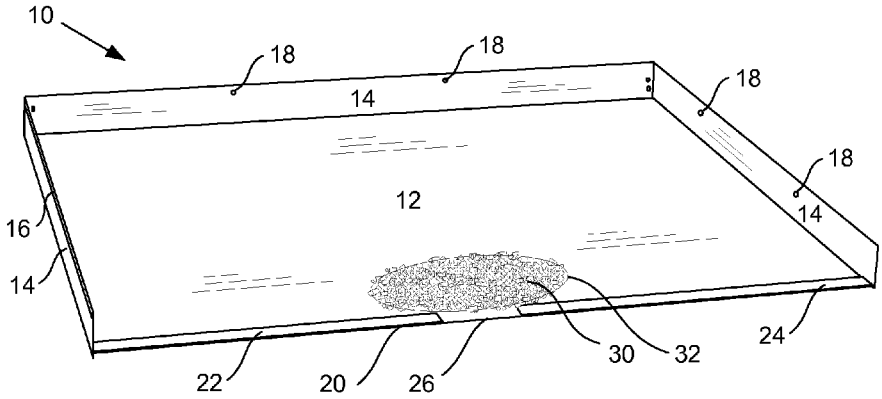
FIG. 7 is a perspective view of the first alternative embodiment, similar to FIG. 5, but with the addition of a water-soluble binder.

This detailed description will describe the present water damage prevention shunt pan system and method substantially from the back forward, as assembled. Generally, as shown in FIGS. 1-4, the present system and method uses a shunt pan 10 that is installed under an appliance to direct the flow of water into a walkway of a room while preventing water from seeping into walls and cabinets. Walled sides 14 of the shunt pan allow water to collect on the floor 12 of the shunt pan until there is enough volume of water to cause the water to flow past an open side 20 of the shunt pan and into the walkway of a room. In the most preferred embodiments, such as is shown in FIG. 7, an indicator material 30, such as a multi-colored Mylar confetti, is mixed with a water-soluble binder 32 and brushed or sprayed along the open side of the floor of the shunt pan. When the water-soluble binder is dissolved by standing water, the indicator material will be released and carried by the water into the walkway of a room, thereby clearly indicating that a water leak has developed. Alternate embodiments of the present invention will follow the description of the preferred embodiment. Where reference numbers in one figure are the same as another figure, those reference numbers carry substantially the same meaning Preferred sizes, materials and methods of attachment will be discussed, but these preferences are not intended to exclude other suitable or functionally equivalent sizes, materials or methods of attachment.

As shown in FIGS. 1-8, the shunt pan 10 is characterized by a rectangular floor 12 that has three walled sides 14 and an open side 20. The preferred material for making a shunt pan is metal, such as 22 gauge galvanized steel or extruded aluminum, but there are numerous plastic materials that could be substituted without significantly sacrificing durability. To make a metal shunt pan, a flat sheet of metal is cut to include appropriate tabs such that when the metal is bent to form the three walled sides of the shunt pan, the tabs can be spot welded or otherwise secured to form corners where the walled sides join. The floor of the shunt pan is substantially perpendicular to each of the walled sides. If desired, safety edges 16 can be added by folding a few millimeters of the sharp edges along the walled sides against themselves, as is well known in the art. The open side of the shunt pan is not characterized by a wall.

The open side 20 of the shunt pan 10 optionally may included a diversion ridge 22 to encourage the flow of water from the floor 12 toward a portion of the open side rather than toward the open side generally. A diversion ridge may be formed by stamping, molding or otherwise forming a ridge in the floor near the open side, except at a portion of the open side where water flow is desired. A diversion ridge will encourage water collecting on the floor of the shunt pan to flow farther into a walkway so it is more obvious that there is a water leak. Rather than a stamped ridge, the diversion ridge may be a diversion edge 24 that encourages water to exit the floor of the shunt pan along just a portion of the open side by forming a very slightly raised portion or portions along the open side. Like the safety edge already discussed, a diversion edge is formed by folding portions of the open side against the floor of the shunt pan. Diversion ridges shouldn't significantly interfere with the installation of an appliance because their profiles are relatively inconsequential.

Installation of a shunt pan 10 is intended to be a simple process that only requires that the shunt pan be positioned over flooring, below where an appliance will be installed, and then fastened to adjacent kitchen walls, which includes kitchen cabinet walls, in a kitchen using simple fasteners, such as screws, that secure the walled sides 14 to surrounding kitchen walls. Fastener holes 18 can be provided to simplify installation. It would benefit the system to apply a bead of caulk or sealant along seams that are not water tight, especially along or under the open side 20 of the shunt pan. There is no need to shim or otherwise level the shunt pan. An appliance can then be installed over the shunt pan using normal installation procedures. When the appliance fails, it can be removed and repaired or replaced without regard for the shunt pan, which can remain indefinitely.

Figure 5:
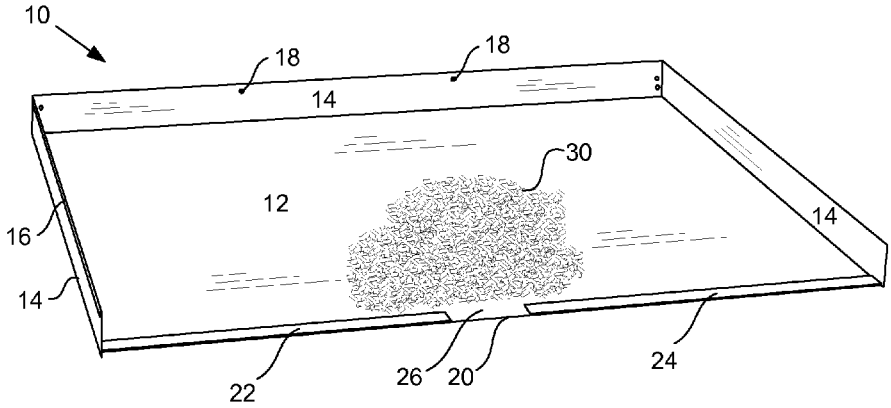
FIG. 5 is a perspective view of a first alternative embodiment characterized by a diversion ridge and an indicator material that is dry.
Figure 6:
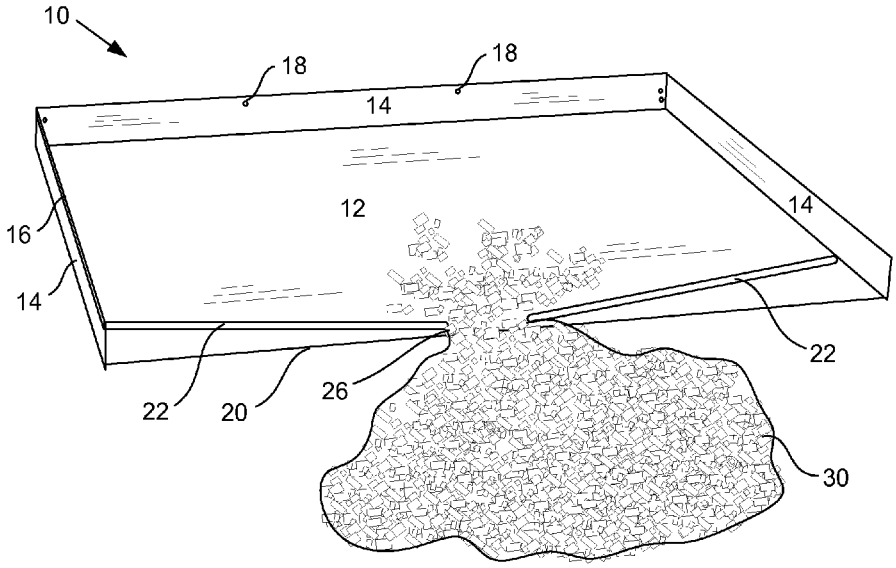
FIG. 6 is a perspective view of a first alternative embodiment characterized by an alternate diversion ridge and an indicator material that has mixed with a water leak.

Preferably, as shown in FIGS. 5-7, the present invention includes an indicator material 30 whose purpose is to direct attention to the presence of a water leak, so the standing water will not be the only indication of a water leak. The indicator material is preferably a colored material that easily mixes with, or is carried by, water. Examples of good indicator materials include, but are not limited to, dyes, chalks, graffiti and confetti. The most preferred indicator material is a multicolored Mylar confetti. Although an indicator material can simply be sprinkled onto the floor of the shunt pan, as shown in FIG. 5, it is preferred that a water-soluble binder 32, such as a water-soluble paste, be used to prevent the indicator material from accidentally blowing away, as shown in FIG. 7. The binder can be mixed with the indicator material and then brushed, sprayed or otherwise applied to the floor 12 of the shunt pan. Once the mixture dries, it should remain on the floor of the shunt pan until water dissolves the binder and the indicator material is carried by the water into a walkway, as shown in FIG. 6, where it will be seen as an indication of the presence of a water leak. A significant advantage of an indicator material is that it will remain in a walkway even if the water that carried it evaporates.

Rather than using a water-soluble binder, an indicator material may be encapsulated or covered with a water-soluble coating. This coating will dissolve when water flows into contact with it, thus allowing the water to carry the released indicator material out from under the appliance and into a walkway. The indicator material could be encapsulated in one or more gel-capsules, which could be positioned on the floor of the shunt pan.

Other alternative indicator materials could be substituted or used in conjunction with the preferred indicator material. The water-soluble binder could include a chemical or chemical mixture that reacts with water to produce a strong or pungent odor, or to produce a visible gas, either of which needs to be safe to breath. Such an indicator material would be better for high traffic or commercial kitchens where a visible indicator material on a walkway may be ignored or not immediately noticed.

In an alternate embodiment a magnetic strip, such as magnetic tape, forms a replaceable layer positioned along a front portion of the shunt pan, near the open side, such that flowing water interacts with a binder material containing an indicator material, which is affixed to the magnetic strip, causing the indicator material to absorb or mix with the water to carry a visible or olfactory indicator material into a walkway. Once a water leak flows over the indicator material on the magnetic strip, the indicator material will have been relatively depleted. Therefore, in order to replete the indicator material, the used magnetic strip can be easily removed and a new magnetic strip with indicator material can be positioned on the floor of the shunt pan. For some appliances, such as dishwashers, the magnetic strip may be applied to a kick plate of the appliance rather than to the shunt pan itself, especially if access to the shunt pan is obstructed.

Figure 8:
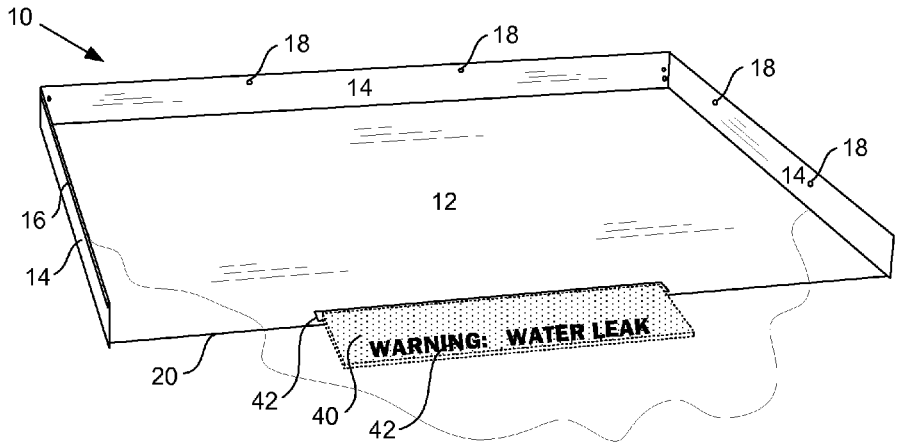
FIG. 8 is a perspective view of a second alternative embodiment characterized by an expanding sponge material and printed warning that there is a water leak.

In yet another alternate embodiment, such as the one shown in FIG. 8, the indicator material 30 is an expanding sponge material 40 that is fixed to a magnetic strip 42 that is placed along the front edge (along the open side 20) of a magnetic shunt pan 10, or to a kick plate of an appliance that is sitting on a shunt pan. When leaking water is absorbed by the expanding sponge material, the sponge material will expand into the visible space or walkway in front of the appliance. This will serve a dual purpose of absorbing some of the problematic leaking water while indicating the presence of a water leak. A printed warning 44 may be printed on the expanding sponge material, the expansion of which will make the warning readable. For example, the warning phrase may state, "Warning: water leak" or any other appropriate warning phrases.

Figure 8A:
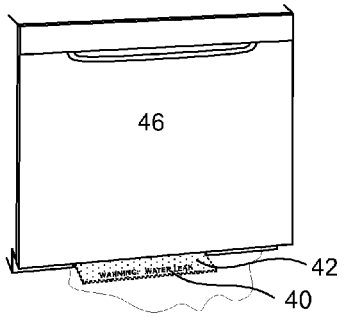
FIG. 8*a* is a perspective view of a kitchen appliance installed over the shunt pan of FIG. 8.

By way of example but not limitation, a shunt pan size that would be appropriate for most 24 inch home appliance dishwashers is approximately 60.5 centimeters wide by 52 centimeters deep by 4 centimeters high. The walled sides on either end of the width may extend forward a couple of centimeters such that those sides may be secured to the kickboard of adjacent cabinetry. The depth of a shunt pan may be trimmed so that it is not visible once a dishwasher is installed over the shunt pan. FIG. 8*a* shows a kitchen appliance 46 installed over a shunt pan of the present invention that includes the expanding sponge material 40, already shown in FIG. 8. As is desired, the shunt pan is not very noticeable when a dishwasher is installed over the shunt pan, but the indicator material is very visible after it has been in contact with water. There are numerous other common sizes that could be offered for refrigerators with ice makes, most of which will be about 50 centimeters deep.

While a preferred form of the invention has been shown and described, it will be realized that alterations and modifications may be made thereto without departing from the scope of the following claims.

What is claimed is:

1. A water damage prevention shunt pan for under a kitchen appliance comprising:

a shunt pan characterized by a broad rectangular floor bordered by three walled sides and an open side;

wherein at least one of the walled sides is fastened to a kitchen wall;

wherein the floor is substantially flat and lies in a horizontal plane;

wherein a kitchen appliance is positioned directly on top of the shunt pan; and an indicator material on the floor of the shunt pan that will mix with a water that collects on the shunt pan.

2. The shunt pan of claim 1, wherein the indicator material is characterized by a powder that changes the appearance of the water.

3. The shunt pan of claim 1, wherein the indicator material is characterized by numerous small particles that are carried by the water.

4. The shunt pan of claim 1, further comprising a water-soluble binder that is mixed with the indicator material.

5. The shunt pan of claim 1, further comprising a water-soluble coating; wherein the indicator material is contained by the water-soluble coating unless the water-soluble coating is dissolved by water.

6. The shunt pan of claim 1, further comprising a diversion ridge.

7. A water damage prevention shunt pan for under a kitchen appliance comprising:

a shunt pan characterized by a broad rectangular floor bordered by three walled sides and an open side;

wherein at least one of the walled sides is fastened to a kitchen wall;

wherein the floor is substantially flat and lies in a horizontal plane;

wherein a kitchen appliance is positioned directly on top of the shunt pan; and an expanding sponge material positioned along a flow path from the shunt pan to a walkway such that the expanding sponge material will absorb the water from a water leak and will grow into the walkway.

8. The shunt pan of claim 7, further comprising a printed warning on the expanding sponge material that becomes clearly visible once the expanding sponge material grows into the walkway.

9. The shunt pan of claim 8, further comprising a means for magnetically attaching the expanding sponge material along the open side of the shunt pan.

10. The shunt pan of claim 7, further comprising a means for magnetically attaching the expanding sponge material to the kitchen appliance along a flow path from the shunt pan to the walkway.

11. A method for preventing water damage caused by a kitchen appliance comprising the steps of:

positioning a shunt pan, characterized by a rectangular floor having three walled sides and an open side, under a kitchen appliance location such that the open side is substantially adjacent a walkway;

installing the kitchen appliance over the shunt pan;

not obstructing water that collects on the shunt pan from flowing past the open side such that the water can collect on the walkway; and placing an indicator material on the rectangular floor of the shunt pan.

12. The method of claim 11 wherein the indicator material is bound by a water-soluble binder.

13. The method of claim 11 wherein the indicator material is contained by a water-soluble coating.

14. The method of claim 11 wherein the rectangular floor is characterized by a diversion ridge that is adjacent at least one portion of the open side, and wherein the step of placing is characterized by placing the indicator material near a portion of the open side that is not characterized by a diversion ridge.

15. A method for preventing water damage caused by a kitchen appliance comprising the steps of:

positioning a shunt pan, characterized by a rectangular floor having three walled sides and an open side, under a kitchen appliance location such that the open side is substantially adjacent a walkway;

installing the kitchen appliance over the shunt pan;

not obstructing water that collects on the shunt pan from flowing past the open side such that the water can collect on the walkway; and fixing an expanding sponge material along a water flow path between the rectangular floor and the walkway such that the expanding sponge material will absorb water from a water leak and will grow into the walkway.

16. The method of claim 15 wherein the step of fixing is characterized by magnetically fixing, such that the expanding sponge material can easily be replaced after it absorbs water.

17. The method of claim 16 wherein the expanding sponge material is characterized by a printed warning.

* * * * *